US006357351B1

(12) United States Patent
Bhambra et al.

(10) Patent No.: US 6,357,351 B1
(45) Date of Patent: Mar. 19, 2002

(54) SUBSTRATE FOR PLANOGRAPHIC PRINTING

(75) Inventors: Harjit S. Bhambra, Leeds; Robert M. Organ, Wantage; Barry Jolliffe, Widnes; Elvyn R. Tolley, Otley, all of (GB)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/441,314

(22) Filed: Nov. 16, 1999

Related U.S. Application Data

(63) Continuation-in-part of application No. 09/077,181, filed on Oct. 19, 1998, now Pat. No. 6,105,500, and a continuation of application No. PCT/GB98/01500, filed on May 22, 1998, and a continuation of application No. PCT/GB98/01496, filed on May 22, 1998.

(30) Foreign Application Priority Data

May 23, 1997 (GB) ..... 9710549
May 23, 1997 (GB) ..... 9710553

(51) Int. Cl.[7] ..... B41N 3/00
(52) U.S. Cl. ..... 101/455; 101/460
(58) Field of Search ..... 101/453, 454, 101/455, 456, 458, 459, 460, 463.1; 427/203, 205

(56) References Cited

U.S. PATENT DOCUMENTS

| | | | |
|---|---|---|---|
| 2,714,066 A | 7/1955 | Jewett et al. | 101/456 |
| 3,181,461 A | 5/1965 | Fromson | 101/456 |
| 3,470,013 A | 9/1969 | Wagner | 101/453 |
| 3,640,221 A | 2/1972 | Wyke | 101/453 |
| 3,963,594 A | 6/1976 | Brasko | 205/658 |

(List continued on next page.)

FOREIGN PATENT DOCUMENTS

| | | |
|---|---|---|
| DE | 112615 | 12/1898 |
| DE | 1118009 | 3/1957Earnshaw, |

(Abstract continued on next page.)

OTHER PUBLICATIONS

"Hawley's Condensed Chemical Dictionary," 10th Ed., G.C. Hawley, Van Nortrand Reinhold, New York, 1987, pp. 1072–1073.

"Chemistry of the Elements," N.N. Greenwood and A. Pergamon Press, Oxford, 1985, pp. 396–398.

*Primary Examiner*—Stephen R. Funk
(74) *Attorney, Agent, or Firm*—Ratner & Prestia

(57) ABSTRACT

A method for preparing a substrate for a planographic printing member is disclosed. A liquid that contains water; a soluble alkali metal silicate, preferably sodium silicate; and a dispersed particulate material is coated on a support, to produce a hydrophilic layer on the support. A layer of image material may be coated over the hydrophilic layer to produce a planographic printing member. In one embodiment the liquid contains a mixture of two particulate materials, preferably alumina and titanium dioxide. The substrate has a surface roughness of about 0.1 $\mu$m to 2 $\mu$m. The substrate is suitable for preparing a planographic printing member processable to a resolution of 10 $\mu$m or less and in which the dots having a roundness of less than 2 are formed.

45 Claims, 5 Drawing Sheets

Example 1, measured at 84 degrees & 50 scans.

U.S. PATENT DOCUMENTS

| | | | | | |
|---|---|---|---|---|---|
| 3,971,660 | A | * | 7/1976 | Staehle | 101/456 |
| 4,052,275 | A | | 10/1977 | Gumbinner et al. | 428/687 |
| 4,072,589 | A | | 2/1978 | Golda et al. | 205/658 |
| 4,131,518 | A | | 12/1978 | Fromson | 101/459 |
| 4,268,609 | A | | 5/1981 | Shiba et al. | 430/271.1 |
| 4,330,605 | A | | 5/1982 | Boston | 430/14 |
| 4,420,549 | A | | 12/1983 | Cadwell | 430/158 |
| 4,457,971 | A | | 7/1984 | Cadwell et al. | 428/323 |
| 4,507,383 | A | | 3/1985 | Tsuruta et al. | 430/302 |
| 4,542,089 | A | | 9/1985 | Cadwell et al. | 430/276 |
| 4,567,131 | A | | 1/1986 | Watkiss | 430/309 |
| 4,581,996 | A | * | 4/1986 | Platzer | 101/459 |
| 4,976,198 | A | * | 12/1990 | Ohba et al. | 101/459 |
| 5,171,650 | A | | 12/1992 | Ellis et al. | 430/20 |
| 5,432,046 | A | * | 7/1995 | Wanat et al. | 101/454 |
| 5,462,833 | A | | 10/1995 | Harquier et al. | 430/159 |
| 5,503,074 | A | * | 4/1996 | Hirano et al. | 101/459 |
| 5,597,677 | A | * | 1/1997 | Kangas et al. | 430/302 |
| 5,807,659 | A | * | 9/1998 | Nishiyama et al. | 101/456 |
| 5,881,645 | A | | 3/1999 | Lenney et al. | 101/463.1 |
| 5,998,044 | A | * | 12/1999 | Limbach et al. | 101/453 |
| 6,105,500 | A | * | 8/2000 | Bhambra et al. | 101/455 |
| 6,138,568 | A | * | 10/2000 | McCullough et al. | 101/465 |
| 6,182,571 | B1 | * | 2/2001 | Jolliffe et al. | 101/455 |

FOREIGN PATENT DOCUMENTS

| | | |
|---|---|---|
| DE | 3144657 | 2/1982 |
| EP | 0028137 | 5/1981 |
| EP | 0110417 | 6/1984 |
| EP | 0514312 | 11/1992 |
| EP | 0565006 | 10/1993 |
| EP | 0619524 | 10/1994 |
| EP | 0619525 | 10/1994 |
| EP | 0620502 | 10/1994 |
| EP | 0653685 | 5/1995 |
| GB | 956376 | 4/1964 |
| GB | 1141566 | 1/1969 |
| GB | 1196886 | 7/1970 |
| GB | 1439127 | 6/1976 |
| GB | 2031442 | 4/1980 |
| GB | 1592281 | 7/1981 |
| GB | 2069164 | 8/1981 |
| GB | 2080964 | 2/1982 |
| GB | 2109573 | 6/1983 |
| GB | 2166255 | 4/1986 |
| GB | 2222553 | 3/1990 |
| IT | MI94000448 | 10/1994 |
| JP | 59214651 | 4/1984 |
| JP | 61123594 | 11/1986 |
| JP | 63268642 | 11/1988 |
| JP | 02003956 | 1/1990 |
| WO | 8901871 | 3/1989 |
| WO | 9112140 | 8/1991 |
| WO | 9405507 | 3/1994 |
| WO | 9719819 | 6/1997 |
| WO | 9822853 | 5/1998 |

* cited by examiner

Example 1, measured at 84 degrees & 50 scans.

SUBSTRATE FOR PLANOGRAPHIC PRINTING

CROSS-REFERENCE TO RELATED APPLICATIONS

This application is a continuation-in-part of U.S. Ser. No. 09/077,181, filed Oct. 19, 1998, now U.S. Pat. No. 6,105,500 and a continuation of International Application Numbers PCT/GB98/01500, filed May 22, 1998, and PCT/GB98/01496, filed May 22, 1998, all of which are incorporated herein by reference.

FIELD OF THE INVENTION

This invention relates to planographic printing and provides a substrate for a planographic printing member and a planographic printing member per se. The invention particularly, although not exclusively, relates to lithographic printing.

BACKGROUND OF THE INVENTION

Lithographic processes involve establishing image (printing) and non-image (non-printing) areas on a substrate, substantially on a common plane. When such processes are used in printing industries, non-image areas and image areas are arranged to have different affinities for printing ink. For example, non-image areas may be generally hydrophilic or oleophobic and image areas may be oleophilic. In "wet" lithographic printing, a dampening or fountain (water-based) liquid is, in general, applied initially to a plate prior to application of ink so that it adheres to the non-image areas and repels oil based inks therefrom. In "dry" printing, ink is repelled from non-image areas due to their release property.

Image and non-image areas can be created by processes that include a step of exposing a layer of image material on the surface of the substrate to radiation. The exposure to radiation creates solubility differences in the image material corresponding to image and non-image areas. During development, the more soluble areas are removed, leaving a pattern on the substrate corresponding to the image.

The properties of lithographic plates are highly dependent on the substrate itself and particularly its uppermost surface, since it is this surface which must bond with image material prior to imaging of the plate but allow release of soluble image material during development and, furthermore, it must be non-ink accepting and thereby define non-image areas of the plate.

Other important properties affected by the substrate may include the following:

a) the shape of dots (or other printing areas) on the plate;

b) the resolution obtainable using the plate;

c) the range of dots obtainable using the plate;

d) the exposure latitude of the plate;

e) the ink-water balance of the plate;

f) the number of prints obtainable using (and, therefore, the durability of) the plate;

g) the speed of the plate;

h) the tendency of the plate to pick-up ink in non-image areas;

i) the aesthetics of the plate pre- and post-development.

The accurate reproduction of dots (or other printing areas) in terms of their size and/or shape (e.g., properties a) to c)) is becoming more and more important for use in applications such as stochastic printing and/or high quality color printing.

Accordingly, plates that can accurately reproduce dots and have other advantageous properties are highly desirable. In addition, there is some evidence of a movement in the printing field towards plates with a wider exposure latitude (property d)). Properties such as e), f) and h) are properties that always need to be optimized whilst property i) is a desirable property to optimize, because good plate aesthetics may affect a printer's perception of the quality of a plate and make it easier for the printer to inspect the quality of an image produced, for example pre- or post-development.

One of the most common substrates used in lithographic printing comprises an aluminum base layer that is treated to make it ready for use. For example, the aluminum may be roughened, for example by electrograining, anodized and then conditioned by chemical means, for example by treatment with water, a solution of phosphate or silicate salt, or a polycarboxylic acid.

However, one problem associated with the use of an electrograined and anodized aluminum substrate is its poor ability to accurately reproduce dots. Another problem is the expense (both economically and environmentally) of preparing the substrate.

It is also well-known to prepare a substrate by applying a hydrophilic layer on a support of, for example, aluminum or plastic. Numerous different hydrophilic layers have been proposed that possess a whole range of chemistries and morphologies. However, very few printing plates of the type described have been commercialized. Those that have tend to have poor properties and are generally used for low quality, short run length applications. Thus, a need exists for a substrate for a printing member that can accurately reproduce dots, is economically and environmentally easy to produce, and yet can be used for high quality, long run applications.

SUMMARY OF THE INVENTION

This invention addresses the problems associated with printing members. In particular, in one embodiment the invention is a substrate for a planographic printing ember, the substrate comprising:

a support; and a hydrophilic layer;

in which:

the hydrophilic layer comprises a particulate material and a binder for the particulate material; and the hydrophilic layer has a surface roughness of about 0.1 $\mu$m to 2 $\mu$m.

In a preferred embodiment, the hydrophilic layer comprises a mixture of two particulate materials, preferably alumina and titanium dioxide. In another embodiment, the invention is a planographic printing member comprising the substrate and an image layer over the hydrophilic layer. In other embodiments, the invention is a method for forming the substrate and a method for forming the planographic printing member.

The substrate is suitable for preparing a planographic printing member having a resolution of 10 $\mu$m or less and in which the dots having a roundness of less than 2 are formed.

DETAILED DESCRIPTION OF THE INVENTION

Substrate

Figure 1:
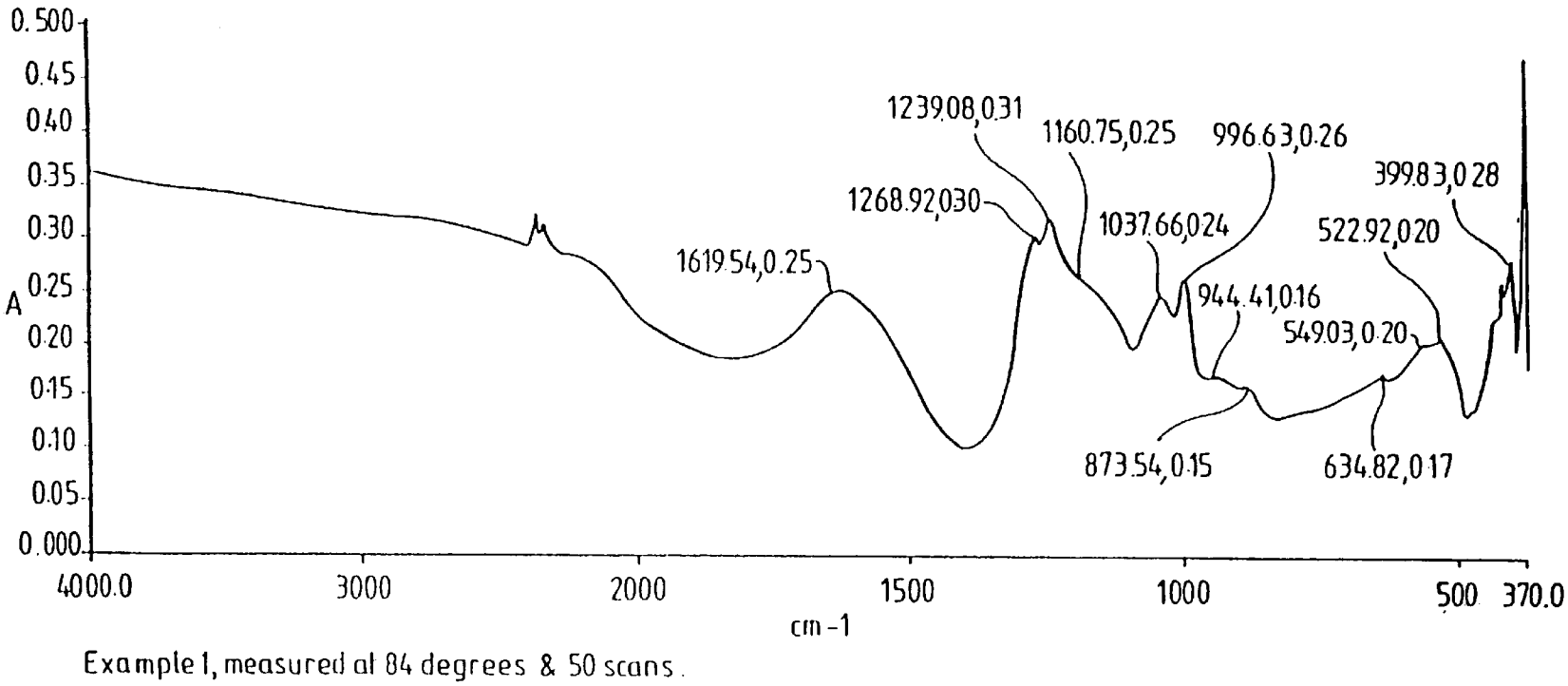
FIG. 1 is a reflectance FT-IR spectrum of the substrate of Example 6.

In a first aspect, the invention is a substrate for a planographic printing member. The substrate comprises a support and a hydrophilic layer. The hydrophilic layer has a surface roughness (Ra) in the range of 0.1 μm to 2 μm and comprises a particulate material and a binder for the particulate material.

It has been found that, if the Ra is too low, the adhesion of the image layer is poor and run length is accordingly low. On the other hand, if Ra is too high, then properties a) to d) and g) are detrimentally affected.

The Ra may be at least 0.2 μm, typically at least 0.25 μm, preferably at least 0.3 μm, more preferably at least 0.35 μm, especially at least 0.4 μm. The Ra may be less than 1.5 μm, typically less than 1 μm, preferably less than 0.8 μm, more preferably less than 0.7 μm, especially less than 0.6 μm, most preferably less than 0.5 μm. The Ra in a first direction, across the plate is preferably substantially the same as the Ra perpendicular to the first direction.

Various types of instruments are known for the measurement of Ra. For example Ra may be measured using a Talkysurf Plus unit fitted with a 112/2564-430 head, supplied by Rank Taylor Hobson Inc of Leicester, U.K. Confirmation that the hydrophilic layer comprises a particulate material and a binder can be made by the use of Scanning Electron Microscopy (SEM) as described in Assessment 5 hereinafter.

The hydrophilic layer may have a surface skewness (Ssk) of greater than −0.5, preferably greater than −0.2, more preferably greater than 0, especially greater than 0.5, most preferably greater than 1.0. The Ssk may be less than 2.0, preferably less than 1.5, more preferably less than 1.4, especially less than 1.2.

Ssk may be measured using any suitable instrument. A stylus measuring instrument is preferably used, such as a Rank Taylor Hobson Form Talysurf 3D unit fitted with a stylus of radius 2 μm as described in Assessment 2 hereinafter.

Preferably, an elemental analysis of the hydrophilic layer by energy dispersive X-ray analysis (EDX), especially the binder thereof, shows that it includes the elements silicon and oxygen. Preferably, elemental analysis shows that the hydrophilic layer includes the element aluminum. Preferably, the analysis shows the layer includes the element titanium. The % of silicon measured as described in Assessment 6 is preferably in the range 10%–20%, more preferably 11%–17%. The % of oxygen measured the same way is preferably in the range 5%–12%, more preferably 7%–11%. The % of aluminum measured in the same way is preferably in the range 40%–60%, more preferably 45%–55%. The % titanium is preferably in the range 15%–30%, more preferably 19%–25% (when assessing the K alpha electron energy level). The elemental analysis may be carried out using energy dispersive X-ray analysis, for example as described in Assessment 6 hereinafter.

The ratio of titanium to aluminum in the hydrophilic layer may be in the range 0.5 to 2, preferably 0.75 to 1.25, more preferably 0.9 to 1.1. The ratio of (Al+Ti):Si in the layer may be in the range 1 to 10, preferably 2 to 6, more preferably 3 to 5.

Preferably, a reflectance FT-IR spectrum of the hydrophilic layer has at least one peak in one (but preferably has at least one peak in each) of the following ranges: 1200 to 1300 $cm^{-1}$ (especially in the range 1220 to 1280 $cm^{-1}$), 1100 to 1200 $cm^{-1}$ (especially in the range 1130 to 1190 $cm^{-1}$) and 900 to 1000 $cm^{-1}$ (especially in the range 920 to 980 $cm^{-1}$).

Preferably, an ultraviolet-visible absorbence spectrum shows that, on lowering the wavelength, absorbence starts to increase rapidly at a wavelength in the range 380 to 430 nm, preferably 390 to 420 nm, and reaches a value of greater than 1.

The hydrophilic layer preferably includes a material having Si—O bonds. Preferably, the binder includes the material having Si—O bonds. The binder material may be a component of a polymeric material that includes Si—O bonds. The polymeric material may include —Si—O—Si—, especially —Si—O—Si— moieties.

At least 50 wt %, typically at least 60 wt %, preferably at least 70 wt %, more preferably at least 80 wt %, especially at least 90 wt % of the binder material is made up of a polymeric material having Si—O bonds as described. Preferably, the binder material consists essentially of a polymeric material having Si—O bonds as described.

The binder material may make up at least 5 wt %, preferably at least 10 wt %, more preferably at least 15 wt %, especially at least 20 wt % of the hydrophilic layer. The binder material may make up less than 50 wt %, preferably less than 40 wt %, more preferably less than 30 wt %, especially less than 25 wt %, of the hydrophilic layer.

The binder material may be derived or derivable from a silicate material for example water glasses, metasilicates, orthosilicates, sesquisilicates and modified silicates such as borosilicate and phosphosilicate. The binder material is preferably derived or derivable from a silicate solution.

The binder material preferably includes less than 10 wt %, preferably less than 5 wt %, more preferably less than 1 wt %, especially substantially no, organic material, for example polymeric organic material.

The particulate material is preferably dispersed in the binder material. Typically, 30 to 85 wt %, preferably 40 to 80 wt %, more preferably 50 to 80 wt %, especially 60 to 80 wt % of the hydrophilic layer is composed of the particulate material.

The particulate material may be organic or inorganic. Organic particulate materials may be provided by latexes or organosols or polymeric balls, such as of nylon. Inorganic particulate materials may be selected from alumina, silica, silicon carbide, zinc sulfide, zirconia, barium sulfate, talcs, clays (e.g. kaolin), lithopone and titanium oxide.

The particulate material may comprise a first particulate material. The first material may have a hardness of greater than 8 Modified Mohs (on a scale of 0 to 15), preferably greater than 9 and, more preferably, greater than 10 Modified Mohs. The first material may comprise generally spherical particles. Alternatively, the material may comprise flattened particles or platelets. The first material may have a mean particle size of at least 0.1 μm, preferably at least 0.5 μm and, more preferably at least 1 μm. The first material may have a mean particle size of less than 200 μm, typically less than 100 μm, preferably less than 45 μm, more preferably less than 20 μm, especially less than 10 μm and, most preferably, less than 5 μm. The particle size distribution for 95% of particles of the first material may be in the range 0.01 to 150 μm, preferably in the range 0.05 to 75 μm, more preferably in the range 0.05 to 30 μm. The first material preferably comprises an inorganic material. The first material preferably comprises alumina, which term includes $Al_2O_3$ and hydrates thereof, for example $Al_2O_3.3H_2O$. Preferably, the material is $Al_2O_3$.

The hydrophilic layer may include at least 10 wt %, typically at least 20 wt %, preferably at least 25 wt %, more preferably at least 30 wt %, especially at least 35 wt % of the first particulate material. The hydrophilic layer may include less than 80 wt %, typically less than 70 wt %, preferably less than 60 wt %, more preferably less than 50 wt %, especially less than 40 wt % of the first particulate material.

The ratio of the wt % of the first particulate material to binder material may be in the range 0.5 to 2, preferably in the range 1 to 2, more preferably in the range 1.4 to 1.8.

The particulate material may comprise a second particulate material. The second particulate material may have a mean particle size of at least 0.001 μm, typically at least 0.005 μm, preferably at least 0.01 μm, more preferably at least 0.05 μm, especially at least 0.1 μm. The mean particle size may be less than 200 μm, typically less than 100 μm, preferably less than 50 μm, more preferably less than 10 μm, especially less than 1 μm, most preferably less than 0.5 μm.

The hydrophilic layer may include at least 10 wt %, typically at least 20 wt %, preferably at least 25 wt %, more preferably at least 30 wt %, especially at least 35 wt % of the second particulate material. The hydrophilic layer may include less than 80 wt %, typically less than 70 wt %, preferably less than 60 wt %, more preferably less than 50 wt %, especially less than 40 wt % of the second particulate material.

The second material is preferably a pigment. The second material is preferably inorganic. The second material is preferably titanium dioxide.

The ratio of the wt % of the second particulate material to binder material may be in the range 0.5 to 2, preferably in the range 1 to 2, more preferably in the range 1.4 to 1.8.

The first and second materials preferably define a multimodal, for example a bimodal, particle size distribution.

The ratio of the wt % of the first particulate material to the second particulate material may be in the range 0.3 to 3, preferably 0.5 to 2, more preferably 0.75 to 1.33, especially about 1:1.

The hydrophilic layer may include one or more additional materials for improving its adhesion to a support, especially a plastic support. A preferred additional material is organic and is preferably polymeric. Resins are preferred.

The support may comprise a metal layer. Preferred metals include aluminum, zinc and titanium, with aluminum being especially preferred. The support may comprise an alloy of the aforesaid metals. Other alloys that may be used include brass and steel, for example stainless steel.

The support may comprise a non-metal layer. Preferred non-metal layers include layers of plastic, paper or the like. Preferred plastics include polyester, especially polyethylene terephthlate.

The support may include one or a plurality of layers. Where the support comprises a plurality of layers, it may comprise a plastic, paper or textile layer and another layer. The other layer may be a metal layer, typically of a type described above. In this case, the support may comprise a metal to plastic or metal to paper laminate; or metal may be applied by other means to plastic or paper, for example by sputtering or the like.

The support may be any type of support used in printing. For example, it may comprise a cylinder or, preferably, a plate. The support may have a width of at least 10 cm, typically at least 20 cm, preferably at least 30 cm, more preferably at least 40 cm, especially at least 50 cm. The support may have a width of less than 300 cm, typically less than 200 cm, preferably less than 160 cm, more preferably less than 100 cm, especially less than 80 cm.

The support may comprise a web of material, which may have a width as described above. Preferably the web has a width in the range 0.7 m to 1.5 m.

The support may have a length of at least 20 cm, typically at least 40 cm, preferably at least 60 cm. The support may have a length of less than 300 cm, typically less than 250 cm, preferably less than 200 cm, more preferably less than 150 cm, especially less than 105 cm.

The support may have a thickness of at least 0.1 mm. The support may have a thickness of less than 0.6 mm.

The support may be pretreated prior to the application of the hydrophilic layer by one or more conventional methods used in the surface treatment of aluminum or other supports, for example caustic etch cleaning, solvent etching, acid cleaning, brush graining, mechanical graining, slurry graining, sand blasting, abrasive cleaning, electrocleaning, solvent degreasing, ultrasonic cleaning, alkali non-etch cleaning, primer coating, flame treatment, grit/shot blasting and electrograining. Details of such methods are given in: "The surface treatment and finishing of aluminum and its alloys" S. Wernick, R. Pinner and P. G. Sheasby published by Finishing Publication Ltd, ASM International, 5th edition 1987.

The support may be provided with a roughened surface over which the hydrophilic layer may be provided. Alternatively, a subbing layer or layers may be provided over the support. In another example, the support may be subjected to a corona treatment.

A subbing layer may include a polymeric or polymerizable material, which may be organic or inorganic. The layer may comprise a proteinaceous material, for example gelatin or a resin which may include or be prepared using monomers selected from vinyl moieties, such as styrene; alkenyl moieties such as butadiene; and acid moieties such as acrylic. The resin may include ester or carboxylic acid functional groups. Preparation of substrates with subbing layers is disclosed in Bhambra, WO 98/52769, incorporated herein by reference.

The substrate may have a whiteness (L) value of at least 75, preferably at least 80, more preferably at least 82. The substrate may have a whiteness value of less than 100, preferably less than 90, more preferably less than 87.

The substrate may have a gloss value of at least 5, preferably at least 7, more preferably at least 9. The substrate may have a gloss value of less than 20, preferably less than 18, more preferably less than 15, especially less than 13.

The hydrophilic layer may have an average thickness of less than 100 μm, typically less than 50 μm, preferably less than 20 μm, more preferably less than 10 μm, especially less than 5 μm. In some cases, the layer may have an average thickness of less than 3 μm. The hydrophilic layer may have an average thickness of greater than 0.1 μm, typically greater than 0.3 μm, preferably greater than 0.5 μm, more preferably greater than 1 μm.

The hydrophilic layer may include 1 to 20 g of material per meter squared of substrate. Preferably the layer includes 3 to 20 g, more preferably 5 to 18 g, of material per meter squared of substrate. Most preferably, the layer includes 8 to 16 g of material per meter squared.

Preferably, substantially the entire hydrophilic layer can be removed by immersing a support including the layer in a stripping solution at a temperature of 96° C. for 20 minutes and rubbing cotton wool over the layer. The stripping solution may comprise potassium dichromate (160 g), phosphoric acid (85%, 460 g) and water (2700 g). Removal of the layer as described may enable the weight of the hydrophilic layer to be assessed.

Printing Member

In a second aspect, the invention is a printing member comprising a substrate as described according to the first aspect and an image layer.

Unless otherwise stated or unless the context otherwise requires, the assessment as to whether a substrate of a printing member is as described according to the first aspect may involve removing the image layer, for example by exposure and/or development.

The term "image layer" includes a layer that can subsequently be partially removed in order to define areas to be printed and includes a layer that already defines areas to be printed. The image layer may include one or a plurality of layers.

The image layer may be provided over the entire surface of the hydrophilic layer. It may comprise any known photosensitive material whether arranged to form a positive or negative plate. Examples of photosensitive materials include diazonium/diazide materials; polymers that undergo depolymerization or addition photopolymerization; and silver halide gelatin assemblies. Examples of suitable materials are disclosed in: GB 1,592,281; GB 2,031,442 [Vikesland, U.S. Pat. No. 4,247,616]; GB 2,069,164; GB 2,080,964; GB 2,109,573; EP 0,377,589; Shiba, U.S. Pat. No. 4,268,609; and Watkiss, U.S. Pat. No. 4,567,131. Preferably, the light sensitive material is a quinone diazide material.

Alternatively, the image layer in the form of a desired image for use in planographic printing may be deposited over the hydrophilic layer by a deposition process such as ink jet or laser ablation transfer. An example of the latter is described in Ellis, U.S. Pat. No. 5,171,650.

The image layer is preferably arranged to be removed during or after exposure to radiation, in order to define areas to be printed.

It has been found that printing members which are imaged using, for example ultraviolet radiation, visible light, thermal infrared radiation can all benefit from using a substrate of the type described, as can printing members prepared by depositing an image layer information-wise on the substrate.

The printing member may be processable to a resolution of 10 $\mu$m or less, typically 9 $\mu$m or less, preferably 8 $\mu$m or less, more preferably 7 $\mu$m or less, especially 6.5 $\mu$m or less.

Resolution is preferably assessed as described under point 2 in Praxis Report 34 (June 1996) (except that the modification described in Assessment 11 hereinafter is followed) published by FOGRA Forschungsgesellschaft Druck e.V. of Munich, Germany and the contents of the report are incorporated herein by reference.

The printing member may be processable to give dots having a roundness of less than 2, preferably less than 1.8, more preferably less than 1.6, especially less than 1.4, when the image is digitized to a resolution of 1.32 pixels.$\mu m^{-1}$.

Roundness may be assessed by capturing an image of exposed 5% UGRA dot screen areas, determining the dot area (a) and the dot perimeter (b) and calculating roundness according to the formula: roundness=$b^2/4\ \Pi a$.

The printing member may have a broad exposure latitude, typically of greater than 1.2, preferably greater than 1.3, more preferably greater than 1.35, especially greater than 1.4.

Exposure latitude may be assessed as described under point 7 in the Praxis Report 34 referred to above (except that the modification described in Assessment 12 hereinafter is preferably followed).

The printing member may have a broad dot range, following exposure and development conditions that give rise to a Stouffer Clear 3, typically of 99% or greater, preferably 99.5% or greater at one extreme; and 2.0% or less, preferably 1.0% or less at the other extreme.

The dot range may be assessed as described under point 6 in the Praxis Report 34 referred to above.

The printing member may be for use in stochastic printing, in which image areas include dots of less than 20 $\mu$m maximum diameter, typically less than 18 $\mu$m maximum diameter, preferably less than 16 $\mu$m maximum diameter, more preferably less than 15 $\mu$m maximum diameter, especially less than 14 $\mu$m maximum diameter are intended to be produced.

The invention also extends to a package with which a printing member as described is associated. The package may include means for restricting the passage of radiation, especially light, from impinging the printing member. The package may be made of a material that is opaque to light. The package preferably fully encloses the printing member.

The invention extends to a plurality of printing members that are associated with one another. For example, one printing member may overlie another printing member. The plurality of printing members may be provided in a package of the type described. Spacing means may be provided between adjacent printing members of the plurality of printing members.

In a third aspect, the invention is a printing member according to the second aspect, which carries printable information. The printing member may have been information-wise exposed so that it carries the printable information. The printing member preferably carries information in a stochastic form.

In a fourth aspect, the invention is a method of printing, the method using a printing member that includes a substrate according to the first aspect. The printing member is preferably capable of printing an area, for example a dot, having a maximum diameter of less than 30 $\mu$m, preferably less than 25 $\mu$m, more preferably less than 20 $\mu$m. Preferably, the method is a method of stochastic printing. The method may be a method of color printing.

The invention also extends to a method of preparing a printing member, the method comprising applying an image layer over the substrate.

Preparation of the Substrate

In a fifth aspect, the invention is a method of preparing a substrate for a planographic printing member. The method comprises the step of forming a hydrophilic layer on a support by contacting the support with a fluid comprising a silicate solution in which particulate material as described in any statement herein is dispersed.

The silicate solution may comprise a solution of any soluble silicate including compounds often referred to as water glasses, metasilicates, orthosilicates and sesquisilicates. The silicate solution may comprise a solution of a modified silicate for example a borosilicate or phosphosilicate.

The silicate solution may comprise one or more, preferably only one, metal or non-metal silicate. A metal silicate may be an alkali metal silicate. A non-metal silicate may be quaternary ammonium silicate.

The silicate solution may be formed from silicate in which the ratio of the number of moles of Si species, for example $SiO_2$, to the number of moles of cationic, for example metal species is in the range 0.25 to 10, preferably in the range 0.25 to about 6, more preferably in the range 0.5 to 4.

The silicate is preferably alkali metal silicate. In this case, the ratio of the number of moles of $SiO_2$ to the number of moles of $M_2O$ in the silicate, where M represents an alkali metal may be at least 0.25, typically at least 0.5, preferably at least 1, more preferably at least 1.5. Especially preferred is the case in which the ratio is at least 2.5. The ratio may be less than 6, preferably less than 5 and more preferably less than 4.

Preferred alkali metal silicates include lithium, sodium and potassium silicates, with lithium and/or sodium silicate being especially preferred. A silicate solution comprising only sodium silicate is most preferred.

The fluid may comprise 2 to 30 wt % of silicate (e.g. dissolved sodium silicate solid), preferably 5 to 20 wt %, more preferably 8 to 16 wt %. The fluid may be prepared using 10 to 60 wt %, preferably 30 to 50 wt %, more preferably 35 to 45 wt % of a silicate solution which comprises 30 to 40 wt % silicate.

The fluid may include 5 to 60 wt % of particulate material. Preferably, the fluid includes 10 to 50 wt %, more preferably 15 to 45 wt %, especially 20 to 40 wt % of particulate material.

The ratio of the weight of silicate to the weight of particulate material in the fluid is preferably in the range 0.1 to 2 and, more preferably, in the range 0.1 to 1. Especially preferred is the case in which the ratio is in the range 0.2 to 0.6.

The fluid may include more than 20 wt %, preferably more than 30 wt %, more preferably more than 40 wt %, especially more than 45 wt % water (including water included in the silicate solution). The fluid may include less than 80 wt %, preferably less than 70 wt %, more preferably less than 65 wt %, especially less than about 60 wt % water.

Where the fluid comprises a silicate and the particulate material comprises a first material and a second material as described, the ratio of the wt % of silicate (e.g. dissolved sodium silicate solid) to the wt % of the first material may be in the range 0.25 to 4, preferably in the range 0.5 to 1.5 and more preferably about 1. Similarly, the ratio of the wt % of silicate to the wt % of the second material may be in the range 0.25 to 4, preferably in the range 0.5 to 1.5 and more preferably about 1. The ratio of the wt % of first material to the wt % of second material may be in the range 0.5 to 2, preferably in the range 0.75 to 1.5, more preferably about 1 to 1.

The particulate material may include a third material, which is preferably adapted to lower the pH of the fluid. The third material may be a colloid, typically colloidal silica or an inorganic salt, typically a phosphate, with aluminum phosphate being preferred. Where a third material is provided, preferably less than 30 wt %, more preferably less than 20 wt %, especially less than 10 wt % of the particulate material is comprised by the third material.

The pH of the fluid may be greater than 9.0, is preferably greater than 9.5 and, more preferably, greater than 10.0. Especially preferred is the case in which the pH is greater than 10.5. The pH is typically controlled so that the silicate remains in solution and does not form a gel. A gel is generally formed when the pH of a silicate solution falls below pH 9. The pH of the fluid is preferably less than 14, more preferably less than 13.

The fluid may include other compounds for adjusting its properties. For example, the fluid may include one or more surfactants. The fluid may include 0 to 1 wt % of surfactant (s). A suitable class of surfactants comprises anionic sulfates or sulfonates. The fluid may include viscosity builders for adjusting the viscosity of the fluid. The fluid may include 0 to 10 wt %, preferably 0 to 5 wt %, of viscosity builder(s). Also, the fluid may include dispersants for dispersing the inorganic particulate material throughout the fluid. The fluid may include 0 to 2 wt % of dispersant(s). A suitable dispersant may be sodium hexametaphosphate.

The fluid may have a viscosity of less than 100 centipoise when measured at 20° C. and a shear rate of 200 $s^{-1}$ using a Mettler Rheomat 180 Viscometer incorporating a double gap measuring geometry. Preferably, the viscosity is less than 50 centipoise, more preferably less than 30 centipoise when measured as aforesaid. Especially preferred is the case in which the viscosity is less than 20 centipoise.

The fluid may be applied to the support by any suitable means, which is preferably non-electrochemical.

The fluid may be applied to both sides of the support to form a hydrophilic layer on both sides. A support with such a layer on both sides may be used to prepare a double-sided lithographic plate. Alternatively, if such a support is used for a single-sided plate, the side of the plate that does not carry the image layer may be protected by the hydrophilic layer. The fluid is preferably applied to only one surface of the support.

The fluid may be applied to the support to form a hydrophilic layer having an average thickness after drying, of less than 20 $\mu$m, preferably less than 10 $\mu$m and, more preferably, less than 5 $\mu$m. Especially preferred is the case in which the average thickness is less than 3 $\mu$m.

The method preferably includes the steps of providing suitable conditions for the removal of water from the fluid after it has been applied to the support. Suitable conditions may involve passive or active removal of water and may comprise causing an air flow over the support and/or adjusting the humidity of air surrounding the support. Preferably, the method includes the step of arranging the support in a heated environment. The support may be placed in an environment so that its temperature does not exceed 230° C., preferably does not exceed 200° C. and, more preferably, does not exceed 175° C. Especially preferred is the case in which the support temperature does not exceed 150° C.

The support may be arranged in the heated environment for less than 180 seconds, preferably less than 120 seconds and, more preferably, less than 100 seconds.

In a sixth aspect, the invention is the use of a substrate according to the first aspect for preparing a printing member having any of the properties described in any statement herein.

Any feature of any aspect of any invention or embodiment described herein may be combined with any feature of any other aspect of any invention or embodiment described herein.

The advantageous properties of this invention can be observed by reference to the following examples, which illustrate, but do not limit the invention.

EXAMPLES

Example 1

Preparation of the Lithographic Printing Plate

Step 1—Preparation of Aluminum

A 0.3 mm gauge aluminum alloy sheet of designation AA1050 was cut to a size of 230 mm by 350 mm, with the grain running lengthways. The sheet was then immersed face up in a solution of sodium hydroxide dissolved in distilled water (100 g/L) at ambient temperature for 60 seconds and thoroughly rinsed with water.

Step 2—Preparation of Coating Formulation

The following reagents are used in the preparation:

Sodium silicate solution having a ratio $SiO_2$:$Na_2O$ in the range 3.17 to 3.45 (average about 3.3); a composition of 27.1–28.1 wt % $SiO_2$, 8.4–8.8 wt % $Na_2O$, with the balance being water; and a density of about 75 Twaddel (°Tw), equivalent to 39.5 Baumé (°Bé) and a specific gravity of 1.375.

Deionized water having a resistivity of 5 Mohm.cm.

$Al_2O_3$ powder comprising alumina (99.6%) in the shape of hexagonal platelets. The mean particle size is 3 $\mu$m. The powder has a hardness of 9 Moh (on a 0–10 hardness scale).

Rutile titanium dioxide with an inorganic coating of $Al_2O_3$, ZnO and $ZnPO_4$. The mean crystal size is 0.23 $\mu$m.

Deionized water (48 g; 24 wt %) and sodium silicate solution (80 g; 40 wt %) were added to a 250 mL beaker and the solution sheared using a Silverson high shear mixer operating at maximum speed. Titanium dioxide powder (36 g; 18 wt %) was then added in portions of approximately 2 g every ten seconds. On completion of the addition, the liquid was sheared for a further two minutes. Then, alumina powder (36 g; 18 wt %) was added in portions of approximately 2 g every ten seconds. On completion of the addition, the liquid was sheared for a further two minutes. The viscosity of the liquid is found to be about 10 centipoise when measured at 20° C. and a shear rate of $200s^{-1}$ using a Mettler Rheomat 180 Viscometer incorporating a double gap measuring geometry.

Step 3—Application of Coating Formulation

The coating formulation prepared in Step 2 was coated onto the aluminum sheet prepared in Step 1 using a rotating Meyer bar coater (designation K303) to give a 6 $\mu$m wet film thickness.

Step 4—Drying the Formulation

The coated sheet prepared in Step 3 was placed in an oven at 130° for 80 seconds. The plate was then removed from the oven and allowed to cool to ambient temperature.

Step 5—Post-drying Treatment

The dried sheet prepared in Step 4 was immersed in aluminum sulfate (0.1 M) for thirty seconds. The sheet was then spray rinsed for about twenty seconds using tap water and fan dried.

Step 6—Application of the Image Layer

A printing plate was produced from the sheet prepared in Step 5 by coating, using a Meyer bar, a light sensitive material of the quinone diazide/novolac resin type at a dry coating weight of 2 g/$m^2$ to form the image layer. The light sensitive material was dried at 130° C. for 80 seconds.

The printing plate prepared in Step 6 was found to have a comparable performance to commercial printing plates. Advantageously, however, it can be produced at a lower cost.

Example 2

The procedure of Example 1 was generally followed except that a different coating formulation was used in step 2. The formulation was prepared by adding the following components to deionized water (40 wt %) in the order given. After each addition, the formulation was subjected to high shear mixing.

| COMPONENT | WT % |
|---|---|
| Hombitan LW anatase $TiO_2$ (mean primary particle size of 0.2 $\mu$m) | 14.2 |
| MICROGRIT ® alumina powder (mean primary particle size of 3 $\mu$m) | 14.2 |
| Sodium silicate solution as in Example 1. | 31.2 |

The printing plate prepared was found to have performance comparable to the plate prepared in Example 1.

Example 3

The procedure of Example 2 was followed except that the following components were mixed in step 2 in the order given below.

| COMPONENT | WT % |
|---|---|
| Deionized water. | 21.51 |
| Hombitan LW anatase titanium dioxide as in Example 2. | 14.15 |
| Alumina powder as in Example 2. | 14.15 |
| Sodium polysilicate solution—having a $SiO_2$:$Na_2O$ ratio of 5.2:1 and containing 22.78% solid. | 50.19 |

The printing plate prepared was found to have a performance comparable to the plate prepared in Example 1.

Example 4

The procedure of Example 2 was followed by mixing the following components in step 2 in the order given below.

| COMPONENT | WT % |
|---|---|
| Deionized water. | 33.29 |
| Hombitan LW anatase titanium dioxide as in Example 2. | 11.83 |
| Alumina powder as in Example 2. | 11.83 |
| BINDZIL ® 15/500 colloidal silica, average particle size of 7 nm | 1.1 |
| Sodium polysilicate as in Example 3. | 41.95 |

The printing plate prepared was found to have a performance comparable to the plate prepared in Example 1, except for a slight dye stain of the hydrophilic layer.

Example 5

The procedure of Example 2 was followed by mixing the following components in step 2 in the order given below.

| COMPONENT | WT % |
|---|---|
| Deionized water | 40 |
| Hombitan LW as in Example 2. | 14.23 |
| Alumina powder as in Example 2. | 13.23 |

-continued

| COMPONENT | WT % |
|---|---|
| Fabutit 748 aluminum phosphate | 1.0 |
| Sodium silicate as per Example 1. | 31.5 |

The printing plate prepared was found to have a performance comparable to the plate prepared in Example 1.

Example 6

Preparation of the Lithographic Printing Plate

Step 1—Preparation of Aluminum

A 0.2 mm gauge aluminum alloy sheet of designation AA1050 was cut to a size of 459 mm by 525 mm. The sheet was then immersed face up in a solution of sodium hydroxide dissolved in distilled water (100 g/L) at ambient temperature for 60 seconds and thoroughly rinsed with water.

Step 2—Preparation of Coating Formulation

The following reagents are used in the preparation:

sodium silicate solution having a ratio $SiO_2$:$Na_2O$ in the range 3.17 to 3.45 (average about 3.3); a composition of 27.1–28.1 wt % $SiO_2$, 8.4–8.8 wt % $Na_2O$, with the balance being water; and a density of about 75 Twaddel (°Tw), equivalent to 39.5 Baumé (°Bé) and a specific gravity of 1.375.

deionized water having a resistivity of 5 Mohm.cm.

$Al_2O_3$ powder comprising alumina (99.6%) in the shape of hexagonal platelets. The mean particle size is 3 $\mu$m. The powder has a hardness of 9 Moh (on a 0–10 hardness scale).

Anatase titanium dioxide having a mean primary particle size of 0.2 $\mu$m.

Deionized water (150 g; 40 wt %) was added to a 250 mL beaker and sheared using a Silverson high shear mixer. Titanium dioxide powder (53.29 g; 14.21 wt %) was then added in portions over a period of four minutes with the shearing continuing. Then, alumina powder (53.29 g; 14.21 wt %) was added in portions over a period of four minutes with the shearing continuing. On completion of the addition, sodium silicate solution (118.43 g; 31.58 wt %) was added with shearing for a further three minutes. The viscosity of the liquid was found to be about 10 centipoise when measured at 20° C. and a shear rate of 200 $s^{-1}$ using a Mettler Rheomat 180 Viscometer incorporating a double gap measuring geometry.

Step 3—Application of Coating Formulation

The coating formulation prepared in Step 2 was coated onto the aluminum sheet prepared in Step 1 using a rotating Meyer bar coater (designation K303) to give a 12 $\mu$m wet film thickness.

Step 4—Drying the Formulation

The coated sheet prepared in Step 3 was placed in an oven at 130° C. for 80 seconds. The plate was then removed from the oven and allowed to cool to ambient temperature.

Step 5—Post-drying Treatment

The dried sheet prepared in Step 4 was immersed in aluminum sulfate (0.1 M) for thirty seconds. The sheet was then spray rinsed for about twenty seconds using tap water and fan dried.

Step 6—Application of the Image Layer

A printing plate was produced from the sheet prepared in Step 5 by coating, using a Meyer bar, a light sensitive material of the quinone diazide/novolac resin type at a dry coating weight of 2 g/$m^2$ to form the image layer. The light sensitive material was dried at 130° C. for 80 seconds.

The light sensitive material includes a blue color change dye, which is arranged to change from dark blue to turquoise green on exposure.

Comparative Example 1 (Example C1)

The comparative example was the HORSELL CAPRICORN® positive plate sold by Horsell Anitec of Leeds, England. The plate comprises an electrograined and anodized substrate with a quinone diazide/novolac resin and a dye as described in Example 6, Step 6.

Assessment of Substrates Used in the Preparation of the Plates of Examples 6 and C1

Assessment 1—Surface Roughness (Ra)

This was measured using a Talysurf Plus unit fitted with a 112/2564-430 head, supplied by Rank Taylor Hobson Inc of Leicester, U.K. For each example, the roughness was assessed along a trace length of 15 mm with respective measurements being taken in the direction of the grain of the aluminum and perpendicular to the direction of the grain.

Results are shown in Table 1 in which the Ra stated is an average of 204 runs.

TABLE 1

| Example No. | Ra in $\mu$m in grain direction | Ra in $\mu$m perpendicular to grain direction |
|---|---|---|
| 6 | 0.47 | 0.47 |
| C1 | 0.62 | 0.63 |

Assessment 2—Surface Skewness (Ssk)

The surface skewness (Ssk) can be used to describe the shape of the surface height distribution. For a Gaussian surface which has a symmetrical surface height distribution, the skewness is zero. For an asymmetric surface height distribution, the skewness may be negative if the distribution has a longer tail at its lower side of the mean plane, or positive if the distribution has a longer tail at the upper side of the mean plane.

A Rank Taylor Hobson Form Talysurf 3-D unit fitted with a stylus of radius 2 $\mu$m was used to map an area of 200 $\mu$m by 200 $\mu$m for each of the examples. Results are given in Table 2.

TABLE 2

| Measurement | Example 6 | Example C1 |
|---|---|---|
| Sa, $\mu$m (mean deviation from plane) | 0.45 | 0.79 |
| Sq, $\mu$m (root mean square deviation from plane) | 0.58 | 1 |
| Sp, $\mu$m (maximum distance above mean plane) | 4.06 | 2.33 |
| Sv, $\mu$m (maximum distance below mean plane) | 1.34 | 4.91 |
| Ssk (skewness) | 1.08 | −0.86 |

The positive value for the Ssk of Example 6 shows that the surface is peak dominated; the negative value for Example C1 shows that the surface is pit dominated.

Assessment 3—Whiteness (L)

This was measured using a Minolta CR-300 processor unit fitted with a CR-331 head, supplied by Minolta U.K. Limited of Milton Keynes, England. The unit was initially calibrated using a white tile supplied (CR-A46). The instrument was configured in its Lab mode (i.e. CIE 1976 color system used) ; used a D65 light source; a 2° observer angle; and it was arranged to produce a value which is an average of three measurements. Measurements were taken firstly with an orientation mark on the measuring head aligned with the direction of the grain of the aluminum and, secondly, with the mark perpendicular to the grain direction so as to give whiteness values in two directions. An average of about 34 readings was taken. Results are given in Table 3.

TABLE 3

| Example No. | L value in metal grain direction (mean, SD) | L value perpendicular to metal grain direction (mean, SD) |
|---|---|---|
| 6 | 84.5, 0.14 | 84.39, 0.47 |
| C1 | 78.54, 0.09 | 78.24, 0.06 |

Assessment 4—Gloss

This was measured using a Minolta Multigloss 268 reflectometer supplied by Minolta U.K. Limited of Milton Keynes, England. The unit was calibrated using an internal standard which is related to a black glass standard with a defined index of refraction (usually 1.567) which equals 100 units.

With a measurement angle of 85° (i.e. the angle from the normal to the plane of interest) measurements were taken in the direction of and perpendicular to the grain as described in Assessment 3. An average value from 3 scans was noted. Results are given in Table 4.

TABLE 4

| Example No. | Gloss units in metal grain direction (mean, SD) | Gloss units perpendicular to metal grain direction (mean, SD) |
|---|---|---|
| 6 | 10.15, 0.48 | 10.4, 0.96 |
| C1 | 18.96, 0.15 | 22.01, 0.4 |

Assessment 5—Scanning Electron Microscopy (SEM)

A sample of substrate prepared as described in Example 6, Step 4, was stuck onto aluminum pin stubs using a conductive paint (Electrodag—a colloidal silver suspension in iso-butyl methylketone). The sample was sputter-coated with platinum using a Fisons Instruments SEM coating system model SC510. The sputter coating was carried out in a low pressure argon plasma for 120 seconds using a plasma current of 20 mA at 900 volts. Microscopy was carried out using the secondary electron detector of a Hitachi S-4100 field emission scanning electron microscope. A condenser lens 8 was used with an accelerating voltage of 10 keV and a working distance of 5 mm. The emission current was 10 pA.

A micrograph was obtained using a magnification of ×1000. A visual assessment of this micrograph shows that the surface morphology is defined by particulate material of two types:

spherical particles of size ~0.2 μm; and angular particles of size ~3–4 μm.

It is also clear that the particles are held in a binder material.

Assessment 6—Energy Dispersive X-ray Analysis (EDX)

A sample of substrate was prepared as described in Assessment 5 except that it was sputter coated with platinum for only 90 seconds.

A Hitachi Scientific Instruments S-4100 field emission scanning electron microscope was used with the following conditions: accelerating voltage 20 kV, condenser lens 8, extraction voltage 4.7 kV, emission current 20 μA, working distance 20 mm, beam monitor aperture 2, objective aperture 1 and magnification 1000×.

Analysis was carried out using an Oxford Instruments Link ISIS 200 EDX system, thermally cyclable SiLi ATW detector (1024 channels, 20 keV range) and software revision 1.04a. The detector was calibrated using a cobalt calibration standard.

The X-ray analysis was carried out using the following acquisition set-up: fast counting mode, process time 3, upper energy 30 keV, preset livetime 200, acquisition rate approximately 7000 counts per second operating with a 30% deadtime. Window integral measurements were made using the "quant" requirement function of the software.

EDX elemental measurements were undertaken for 6 different areas on the sample. The absorption peaks obtained in the EDX spectra were assessed to indicate the elements present and integrated to give an indication of the relative amounts of each of the elements.

The percentage of each element was calculated from: element integral/sum of integrals of all elements noted.

Results are given in Table 5

TABLE 5

| Energy band (KeV) | Element detected | Absorption Band | Mean percentage of |
|---|---|---|---|
| 1.388–1.587 | Aluminum | K alpha | 51.5 |
| 1.648–1.847 | Silicon | K alpha | 14.2 |
| 4.387–4.648 | Titanium | K alpha | 22.7 |
| 4.787–5.068 | Titanium | K beta | 3.2 |
| 0.477–0.608 | Oxygen | K alpha | 8.43 |

Assessment 7—Reflectance FT-IR Spectroscopy

A sample of the substrate of Example 6 of length 10 cm and width 3 cm was cut from a sheet prepared as described in Example 6, step 5 and subjected to reflectance FT-IR using a Perkin Elmer System 2000 FT-IR unit, obtained from Perkin Elmer Limited of England. The sample was mounted on a variable angle reflectance attachment 13969 supplied by Graseby Specac Limited of Kent, England. Scanning of the sample was along the metal grain direction and at a scan angle of 84°. A spectrum obtained is shown in FIG. 1. Peaks are noted at the following wavenumbers ($cm^{-1}$). The figures in brackets after each number represent the level of absorbence : 1619.54 (0.25), 1268.92 (0.30), 1239.08 (0.31), 1160.75 (0.25), 1037.66 (0.24), 996.63 (0.26), 944.41 (0.16), 873.54 (0.15), 634.82 (0.17), 549.03 (0.20) and 522.92 (0.20) and 399.83 (0.28).

Assessment 8—UV-VIS Absorbence Spectrum

A ultraviolet-visible absorbence spectrum was run on a sample of substrate prepared as described in Example 6, Step 5 using a Perkin Elmer Lambda 15 UV/VIS spectrometer, fitted with an integrating sphere attachment and being obtained from Bodenseewek Perkin-Elmer GmbH of Berlingen, Germany. The scanning speed was 240 nm/min, the slit width was 2 nm and the reference sample was 1050 aluminum alloy.

Figure 2:
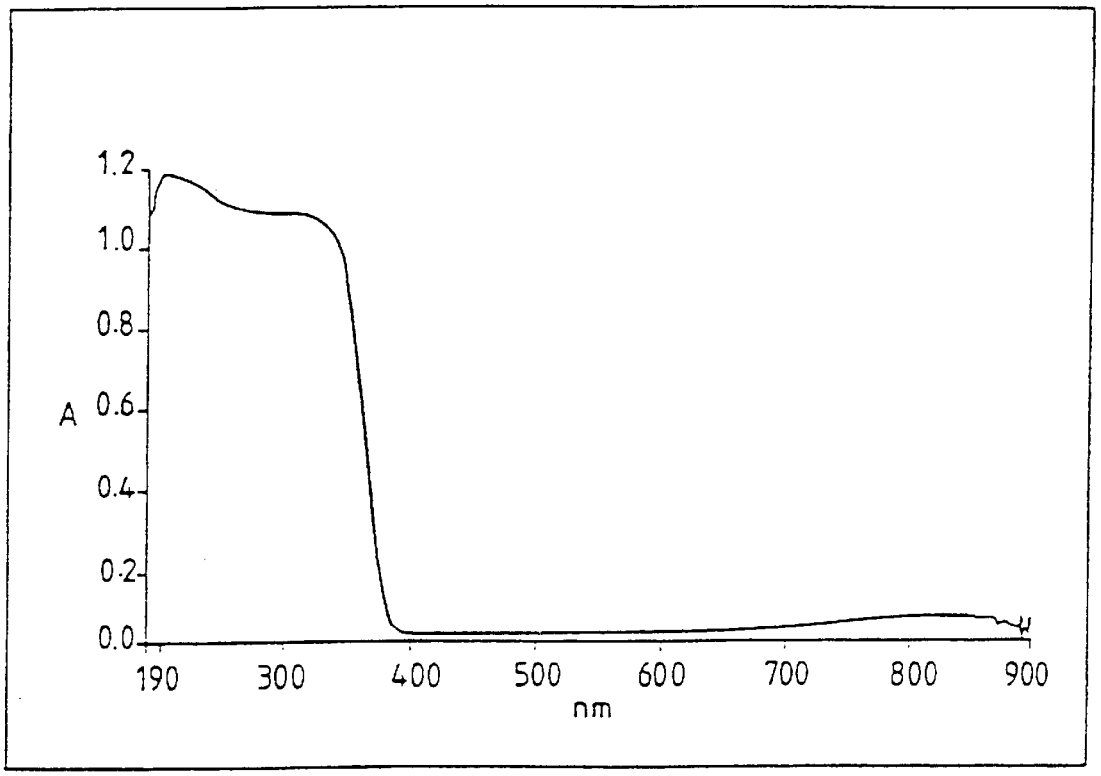
FIG. 2 is an ultraviolet-visible absorbence spectrum of the substrate of Example 6.

The spectrum is shown in FIG. 2 from which it can be seen that, as the radiation wavelength is lowered, absorbence increases rapidly from a value close to 0 at 390 nm to over 1 at 340 nm. Absorption is consistently high below 340 nm.

Assessment of Plates Prepared from Examples 6 and C1

Plates of Examples 6 and C1 were exposed on a Montakop 65 lightframe. Each plate was imaged using a Printstar 21 Step Stouffer Wedge available from Horsell Anitec and an UGRA Plate Control Wedge 1982 obtained from FOGRA of Munich, Germany. Each plate was given sufficient exposure to give a clear Step 3 on the image of the Stouffer wedge after development. The plates were developed at 20° C. for 60 seconds using GREENSTAR™ developer, sold by Horsell Anitec.

Assessment 9—Visual Assessment of Dot Shapes

Figure 3:
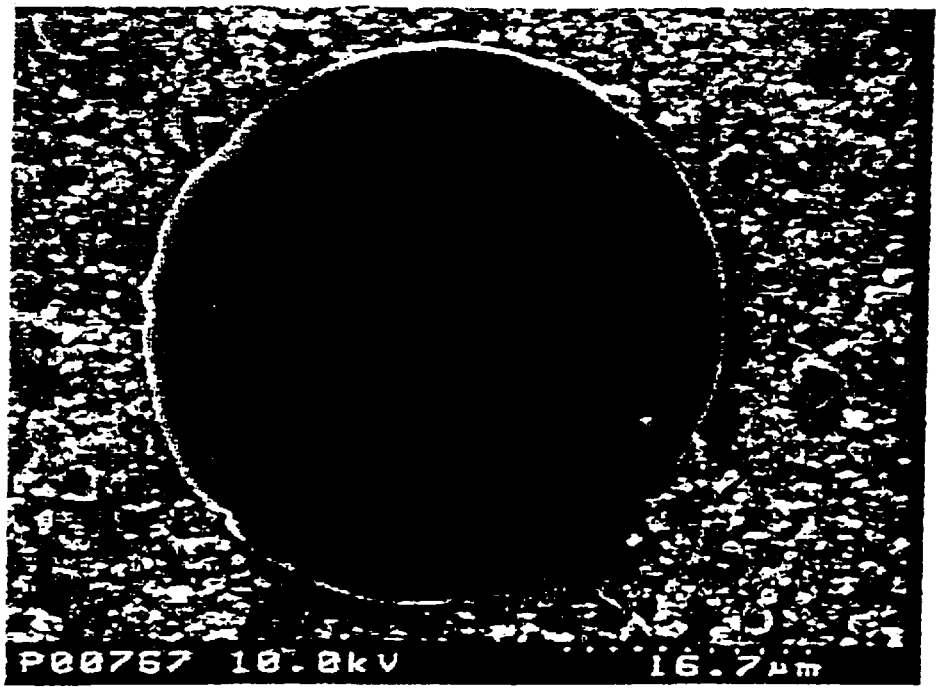
FIGS. 3 and 4 are SEMs of dots produced using the plates of Example 6 and Comparative Example 1, respectively.
Figure 4:
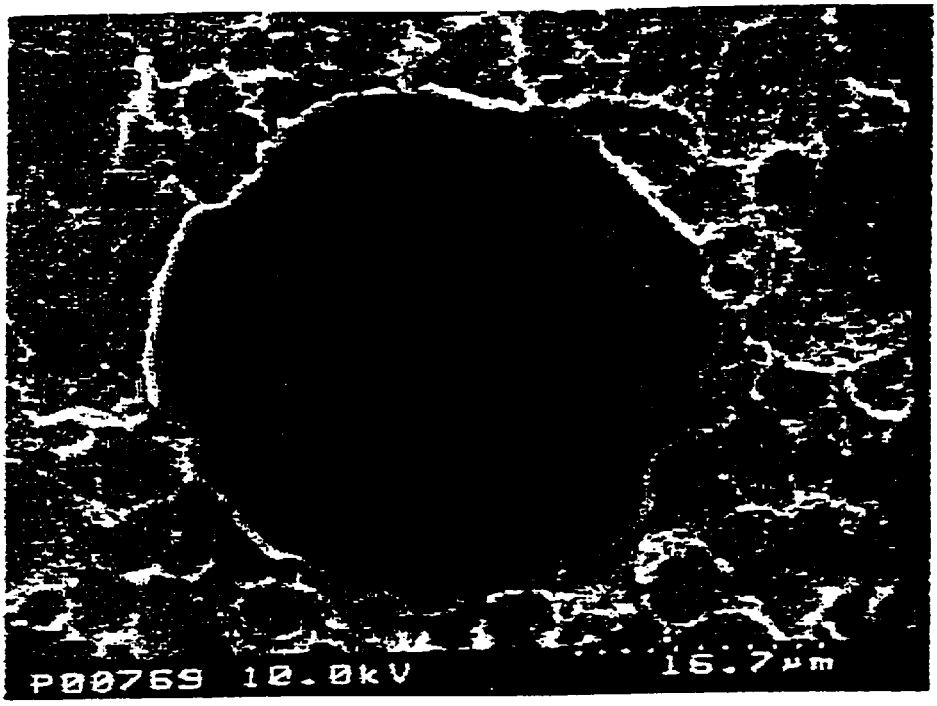

SEMs of dots produced from 5% UGRA dot screen areas were taken and these are shown in FIGS. 3 and 4 for plates of Examples 6 and C1 respectively. The difference in roundness of the dots is easily appreciated: the dot on the plate of Example 6 is substantially circular whereas that of Example C1 is highly irregular.

Assessment 10—Mathematical Roundness of Dots

Figure 5:
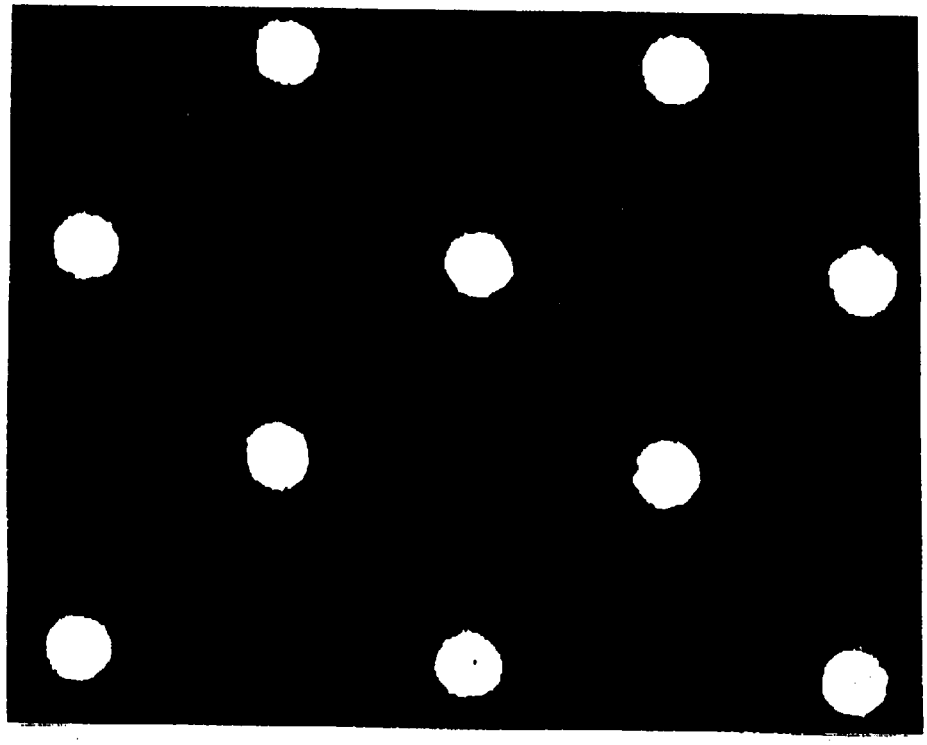
FIGS. 5 and 6 are computer generated masks of dots produced using the plates of Example 6 and Comparative Example 1, respectively.
Figure 6:
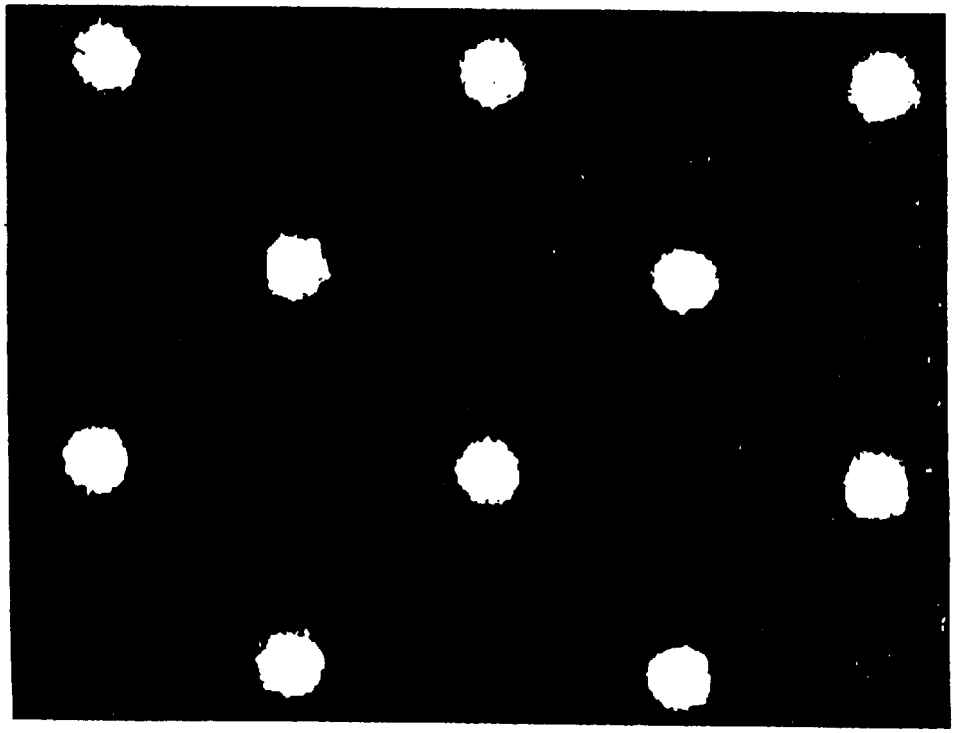

5% UGRA dot screen areas of Examples 6 and C1, prepared as described in Assessment 9, were evaluated by capturing an image of 10 dots using a JVC KY-F55BE 3CCD color video camera fitted to an Olympus BX60 optical microscope set up for dark field illumination and having an Olympus dark field lens (UMP lan fl; 20×/0.46 bd; /O). The microscope and lens were obtained from Olympus Optical Company (UK) Limited of London, England. Computer generated masks were produced for image analysis and these are shown in FIGS. 5 and 6 for Examples 6 and C1, respectively. Image analysis was carried out using Image-Pro Plus Version 1.3 for Windows obtained from Media Cybernetics of Maryland, USA. Image resolution was found to be 1.32 pixels/$\mu$m. Each image was binarized to determine dot area (a) and dot perimeter (b) and the roundness determined by the formula: roundness=$b^2/4\Pi a$. Results are given in Table 6.

TABLE 6

| Example | Roundness | Population Standard Deviation |
|---|---|---|
| 6 | 1.35 | 0.08 |
| C1 | 1.99 | 0.20 |

The values of "a" for the Examples was found to be approximately equal.

Assessment 11—Resolution

Resolution is a quality datum. It was assessed for the plates of Examples 6 and C1 as described under point 2 in Praxis Report 34 (June 1996) published by FOGRA Forschungsgesellschaft Druck e.V. of Munich, Germany, except that, whereas the Report states that: "A microline segment is considered to be featured on the plate if more than half of the total line lengths can be seen", for the Assessment, a microline segment was only considered to be featured if greater than 90% of the total line length could be seen. The plates were processed as described in Assessment 9.

Figure 7:
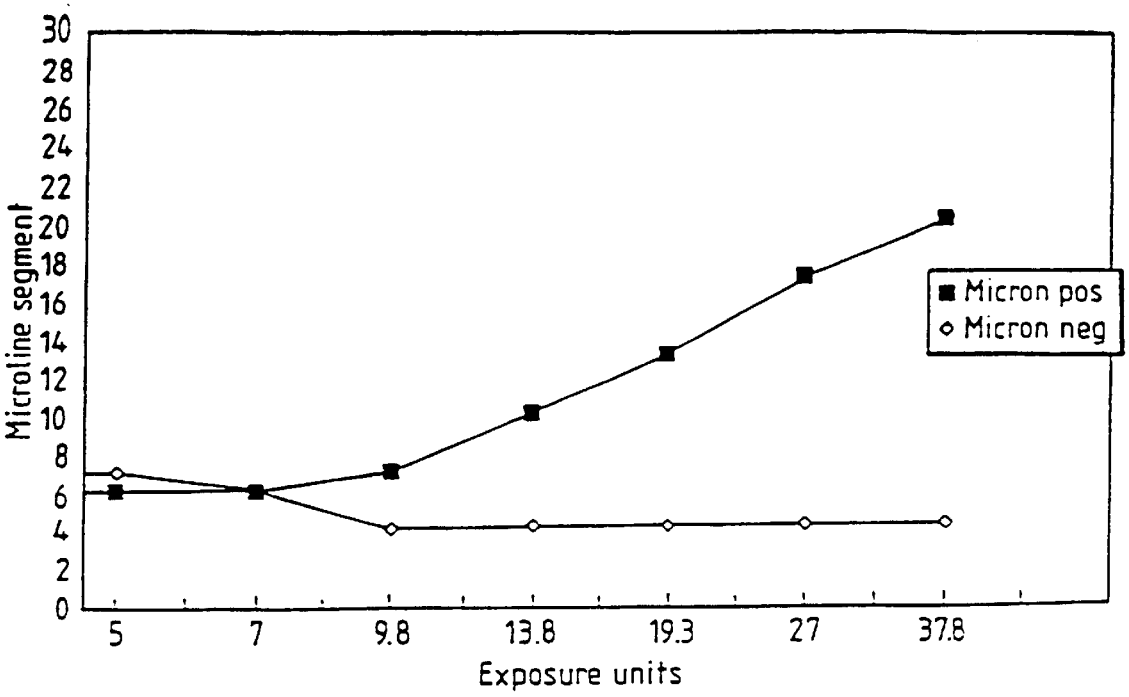
FIGS. 7 and 8 are resolution graphs for the plates of Example 6 and Comparative Example 1, respectively.
Figure 8:
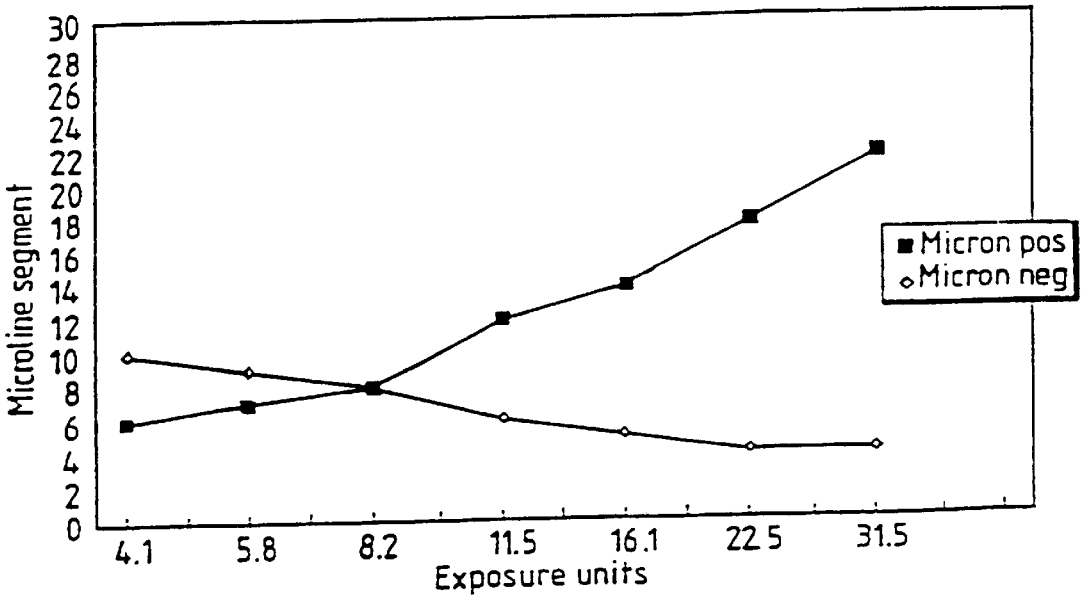

FIGS. 7 and 8 provide resolution graphs for plates of Examples 6 and C1 respectively from which it will be noted that the resolution of Example 6 is about 6 $\mu$m and that of Example C1 is about 8 $\mu$m.

Assessment 12—Exposure Latitude

The exposure latitude of plates of Examples 6 and C1, processed as described in Assessment 9, was assessed as described under point 7 in Praxis Report 34 referred to above, except that a microline segment was only considered to be featured if greater than 90% of the total line length can be seen as described in Assessment 11.

The exposure latitude of Example 6 was found to be 1.44; and that of Example C1 found to be 1.32.

Assessment 13—Dot Range

This was assessed by exposing to Clear 3 on a Stouffer 21 step wedge and as described under point 6 in Praxis Report 34 referred to above on plates processed as described in Assessment 9.

The dot range of Example 6 was found to be 0.5 to 99.5%; and that of Example C1 found to be 1 to 99%.

Assessment 14—Photo-coating Release

The plates were exposed at the lowest exposure (Stouffer Clear 0) and assessed after being processed as described in Assessment 9. The plate of Example 6 appeared clear of photocoat, whereas some photocoat was retained in the grain of the plate of Example C1.

Assessment 15—Ink-water Balance

Plates prepared as described in Example 6 and C1 were run, side-by-side, on a Heidelberg Speedmaster SM52 press with Z-roller fitted using Federal Tait Duo Laser Brilliance 80 g/$m^2$ paper obtained from Rothera & Brereton of Leeds, England; Gibbon JCR Geneva Black Ink, obtained from Gibbon JCR Ltd of Leeds, England; and a fountain solution comprising 2% Emerald fount and 10% isosol obtained from Horsell Graphic Industries Ltd of Leeds, England. The point at which the printed image/non-image boundary became blurred was measured. The point for the plate of Example 6 was within 3% damp of that of Example C1.

Assessment 16—Run Length

After 500,000 impressions on the Heidelberg press referred to in Assessment 15, it was found that:

solid areas continued to print as well as a 5% dot area imaged from a 60 lines $cm^{-1}$ screen.

the background continued to print clearly;

there were no signs of areas of the plate (e.g. the hydrophilic layer) breaking up or falling off.

Assessment 17—Plate Aesthetics

Visual assessment of the plates of Examples 6 and C1 before development showed that Example 6 had better color contrast between the image and non-image areas than Example C1. Following development, it was also noted that Example 6 had better color contrast between the two areas compared to Example C1.

Assessment 18—Developer Resistance

Samples exposed as described in Assessment 9 were developed in a Mercury 650 Processor using GOLDSTAR™ developer sold by Horsell Anitec for 20 seconds dwell time at 14° C. at one extreme; and for 60 seconds dwell time at 35° C. at the other extreme. A shift of 4 steps on the UGRA micron lines was seen for both Example 6 and Example C1. Nonetheless, the plate of Example 6 held onto the 15 $\mu$m lines better than that of Example C1. One concludes, therefore, that the plate of Example 6 has no problem compared to commercial plates as regards developer resistance.

Assessment 19—Stochastic Screens

It was found that the plate of Example 6 reproduced a stochastic screen very satisfactorily. In the assessment, the lowest spot size of 16 $\mu$m diameter was held well at clear 3 Stouffer for Example 6, whereas this spot was virtually eliminated on the plate of Example C1.

Example 7

The procedure of Example 6 was repeated, excepted that MELINEX® 539 biaxial polyethylene terephthlate (PET) film with an anti-static coating (supplied by ICI Melinex of Wilton, England) was used instead of aluminum. The majority of properties of the plate produced were found to be similar to those of Example 6.

Example 8

The procedure of Example 6 was repeated, except that Simcote 400 (a paper obtained from Samuel Grant Ltd of England) was used instead of aluminum. The majority of properties of the plate produced were found to be similar to those of Example 6.

Example 9

A Statistical Experimental Design was set up to assess the effects of varying certain parameters in the formulation of Example 6 Step 2. The following properties were assessed:

(a) The susceptibility of the image to rub off. A 5 mL sample of TONE UP™ plate cleaner (a proprietary plate cleaner sold by Horsell Anitec) was applied to a 5×5 cm area of the plate of Example 6. Then, a wad of damp tightly rolled cotton wool was used to wipe across the image layer using a heavy downward pressure for a total of 50 passes. The plate was rinsed in tap water and the rubbed area was examined for wear. A scale was set in which complete removal of the image layer was given a value of 100 and no removal was given a value of 0.

(b) The susceptibility of the non-image area to staining by the dye in the photocoat. This was assessed using the Minolta CR-300 processor unit referred to in Assessment 3 to assess the extent of any blue color in developed non-image areas.

(c) The susceptibility of the non-image area to ink reception. This was assessed on a developed non-image area coated with a gum and rinsed in tap water, followed by removal of excess water using a rubber blade. A 2 mL drop of ink was applied to a wad of cotton wool and this was wiped across the non-image area to allow the ink to adhere to the non-image area if it could. The plate was then rinsed in tap water to remove any loosely bound ink and the plate assessed.

With regard to (a), it was found that the susceptibility of the area to rub off decreased with increasing the powder (i.e. alumina and titania) to silicate ratio. Additionally, increasing the alumina content of the powder was found to decrease rub off.

With regard to (b), it was found that the susceptibility of the non-image area to staining increased as the ratio of powder to silicate was increased.

With regard to (c), it was found that a reduction in the powder to silicate ratio reduced ink reception.

Example 10

The following are referred to in Examples 10–55.

Stainless Steel A1S1 304 foil—a foil comprising Cr (18 wt %), Ni (10 wt %) and Fe (balance) obtained from Goodfellow Cambridge Limited of Cambridge, England.

Titanium & zinc metals—obtained from Goodfellow Cambridge Limited of Cambridge, England.

MELINEX® 539 film—Biaxial polyethylene terephthlate (PET) with an anti-static coating supplied by ICI Melinex of Wilton, England.

MELINEX® 0 film—As for MELINEX® 539 but no anti-static coating.

PP2500 PET—refers to laser overhead acetates from 3M.

Tektronic PET—refers to an electrophotographic PET.

TYVEK® 55 spunbonded polyolefin—refers to a non-cellulose based paper obtained from Samuel Grant Limited of England.

Simcote 400—refers to a cellulose paper with a polyethylene surface coating and a clear matte finish obtained from Samuel Grant Limited of England.

Simcote 479—refers to a cellulose paper with a polyethylene surface coating and a high density Matt finish obtained from Samuel Grant Limited of England.

KAOWOOL® paper—a paper manufactured from ceramic fibers obtained from Thermal Ceramics Ltd of Merseyside, England.

Simcote 450A1—a paper with a vapor deposited aluminum layer obtained from Samuel Grant Limited of England.

Simcote 450Ag—a paper with a vapor deposited silver layer obtained from Samuel Grant Limited of England.

MYLAR® polyethylene terephthalate film—refers to CRONAR® 486 polyethylene terephthalate film obtained from DuPont.

Glasocol LS26—a styrene acrylic polymer microemulsion obtained from Allied Colloids of Bradford, England.

Epikote 1004—a solid bisphenol A-epichlorohydrin epoxide resin obtained from Shell Resins of England.

PES 613D—a saturate polyester copolymer dispersion (20 wt % in water) obtained from Siber Hegner Limited of 30 Kent, England.

WAC-10 and WAC-20—modified copolyester resin dispersions (20 wt % in water) obtained from Siber Hegner Limited of Kent, England.

Tesafix tape—refers to tesa 4965 double-sided self-adhesive tape comprising a polyester backing and an acrylic adhesive, obtained from Beiersdorf UK Ltd of Milton Keynes, England.

Preparation of the Lithographic Printing Plate

Step 1—Preparation of Aluminum

A 0.2 mm gauge aluminum alloy sheet of designation AA1050 was cut to a size of 459 mm by 525 mm. The sheet was then immersed face up in a solution of sodium hydroxide dissolved in distilled water (100 g/L) at ambient temperature for 60 seconds and thoroughly rinsed with water.

Step 2—Preparation of Coating Formulation

The following reagents are used in the preparation:

Sodium silicate solution having a ratio $SiO_2$:$Na_2O$ in the range 3.17 to 3.45 (average about 3.3); a composition of 27.1–28.1 wt % $SiO_2$, 8.4–8.8 wt % $Na_2O$, with the balance being water; and a density of about 75 Twaddel (°Tw), equivalent to 39.5 Baumé (°Bé) and a specific gravity of 1.375.

Deionized water having a resistivity of 5 Mohm.cm $Al_2O_3$ powder comprising alumina (99.6%) in the shape of hexagonal platelets. The mean particle size is 3 μm. The powder has a hardness of 9 Moh (on a 0–10 hardness scale).

Anatase titanium dioxide having a mean primary particle size of 0.2 μm.

Deionized water (150 g; 40 wt %) was added to a 250 mL beaker and sheared using a Silverson high shear mixer. Titanium dioxide powder (53.29 g; 14.21 wt %) was added in portions over a period of four minutes with the shearing continuing. Alumina powder (53.29 g; 14.21 wt %) was added in portions over a period of four minutes with the shearing continuing. On completion of the addition, sodium silicate solution (118.43 g; 31.58 wt %) was added with shearing for a further three minutes. The viscosity of the liquid was about 10 centipoise measured at 20° C. and a shear rate of 200 $s^{-1}$ using a Mettler Rheomat 180 Viscometer incorporating a double gap measuring geometry.

Step 3—Application of Coating Formulation

The coating formulation prepared in Step 2 was coated onto the aluminum sheet prepared in Step 1 using a rotating Meyer bar coater (designation K303) to give a 12 μm wet film thickness.

Step 4—Drying the Formulation

The coated sheet prepared in Step 3 was placed in an oven at 130° C. for 80 seconds. The plate was then removed from the oven and allowed to cool to ambient temperature. The Ra of the sheet was 0.45 μm, measured using a Hommelmeter T2000 having an LV-50 measuring head.

Step 5—Post-drying Treatment

The dried sheet prepared in Step 4 was immersed in aluminum sulfate (0.1 M) for thirty seconds. The sheet was then spray rinsed for about twenty seconds using tap water and fan dried.

Step 6—Application of the Image Layer

A printing plate was produced from the sheet prepared in Step 5 by coating, using a Meyer bar, a light sensitive material of the quinone diazide/novolac resin type at a dry coating weight of 2 g/m$^2$ to form the image layer. The light sensitive material was dried at 130° C. for 80 seconds.

Examples 11–56

Preparation of Other Substrates

The coating formulation of Example 10, Step 2 was applied as described in Steps 3 and 4 (unless otherwise stated) to supports described in Table 7 below which had, in some cases, been pre-treated as described in the table. In the examples, the pre-treatments (if any) were applied using a Meyer bar to give a wet film thickness of 12 $\mu$m followed by oven drying at 130° C. for 80 seconds.

TABLE 7

| Example No | Support | Pre-treatment |
|---|---|---|
| 11 | Stainless steel annealed A1S1304 foil | None |
| 12 | Titanium (99.7% pure) | None |
| 13 | Zinc (99.9% pure) | Acetone cleaned |
| 14 | Zinc (99.9% pure) | Cleaned in NaOH (5M, 20° C. for 60 seconds) |
| 15 | PP2500 PET | None |
| 16 | Tektronic PET | None |
| 17 | TYVEK ® 55 | None |
| 18 | Simcote 400 | None |
| 19 | Simcote 479 | None |
| 20 | MELINEX ® 539 | PES 613D |
| 21 | KAOWOOL ® | None |
| 22 | MELINEX ® 539 | WAC-10 |
| 23 | Simcote 450A1 | None |
| 24 | Simcote 450 Ag | None |
| 25 | MELINEX ® 539 | 600 grade abrasive paper having approx. 30 $\mu$m abrasive particles was used to abrade the support |
| 26 | MELINEX ® O | As in Example 25. |
| 27 | MELINEX ° 539 | Ronacoat R0300 - dimethyl maleiamide ester from Rohner |
| 28 | MELINEX ® 539 | Synthomer 76D40 - styrene butadiene emulsion from Synthomer of Harlow, England |
| 29 | MELINEX ® 539 | Synthomer 3704 - styrene butadiene copolymer emulsion from Synthomer |
| 30 | MELINEX ® 539 | Synthomer 76D41 - styrene butadiene latex emulsion from Synthomer |
| 31 | MELINEX ® 539 | Synthomer 33H42 - styrene butadiene/acrylate terpolymer from Synthomer |
| 32 | MELINEX ® 539 | Synthomer 78P42 - carboxylated styrene butadiene latex from Synthomer |
| 33 | MELINEX ® 539 | Crodapol 0-41G - polyester resin from Croda |
| 34 | MELINEX ® 539 | Vinyl AW875 (00996) - vinyl copolymer from Union Carbide |
| 35 | MELINEX ® 539 | Texicryl.13-302 - acrylic copolymer emulsion from Scott Bader |

TABLE 7-continued

| Example No | Support | Pre-treatment |
|---|---|---|
| 36 | MELINEX ® 539 | Texicryl 13-214 - acrylic polymer emulsion from Scott Bader |
| 37 | MELINEX ® 539 | Versicol E11 - an acrylic acid copolymer from Allied Colloids |
| 38 | MELINEX ® 539 | SURCOL ® SP2 synthetic polymer - carboxylated acrylic copolymer from Allied Colloids |
| 39 | MELINEX ® 539 | Revacryl 455 - styrene/acrylic ester copolymer from Harco |
| 40 | MELINEX ® 539 | Mowlith 7410 - butyl/ethyl hexyl acrylate styrene copolymer from Harco |
| 41 | MELINEX ® 539 | NEOREZ ® R600 synthetic resin - an aliphatic urethane aqueous dispersion from Zeneca Resins of Cheshire, England |
| 42 | MELINEX ® 539 | NEOCRYL ® BT9 synthetic resin - an anionic acrylic colloidal emulsion from Zeneca Resins of Cheshire, England |
| 43 | MELINEX ® 539 | Viclan VL 804 - an anionic polyvinylidene chloride latices in water from Zeneca Resins |
| 44 | MELINEX ® 539 | NEOREZ ® R961 synthetic resin - an aliphatic polyester/urethane dispersion from Zeneca Resins |
| 45 | MYLAR ® | Aqualok - an acrylic latex paint from Insl-X Products Corporation, New York 10980 |
| 46 | MYLAR ® | Gelatin. The coating formulation of Example 10, Step 3, was applied whilst the gelatin was still wet. |
| 47 | MELINEX ® 539 | WAC-20 |
| 48 | MYLAR ® | 98–99% hydrolyzed PVA and various concentrations of formaldehyde (30–120 mg/g PVA) |
| 49 | MELINEX ® 539 | A mixture comprising Stag epoxy DP394 and titania (5 wt %) in methyl lactate |
| 50 | MELINEX ® 539 | WAC-20 and titania as described above (1 or 5 or 10 wt %) |
| 51 | MELINEX ® 539 | WAC-20 and alumina as described above (1 or 5 or 10 wt %) |

Example 52

The coating formulation of Example 10, Step 2 was applied as described in Example 10, Steps 3 and 4, to an aluminized surface of a laminate obtained from Alcan, which comprises PET (125 $\mu$m thick) and aluminum (25 $\mu$m thick). After drying, the material was immersed in 0.1 M aluminum sulfate at 20° C. for 60 seconds, followed by fan drying and application of a light sensitive coating as described in Example 10, Step 6.

Examples 53 to 55

The coating formulation of Example 10, Step 2 was modified by the inclusion of additives at certain wt %, as specified in Table 8, and applied to a MELINEX® polyester support using a Meyer bar as described with reference to Example 11 et seq.

TABLE 8

| Example No | Additive | Wt % of additive |
|---|---|---|
| 53 | Glasocol LS26 | 5 wt % |
| 54 | WAC-20 | 50 wt % |
| 55 | PES 613D | 5 wt % |

Example 56

Instead of applying a single layer as described in Example 10, step 3, three layers having a 6 μm wet film thickness were applied.

Examples 10–56

Assessments and Observations

Assessment 1: Scratch Resistance

The hydrophilic layers of the substrates prepared as described were assessed for scratch resistance by placing each substrate on a hard flat surface and pressing hard down onto the hydrophilic layer with a fingernail, followed by dragging the nail across the surface. If no coating was removed, then the layer was regarded as scratch resistant.

Assessment 2: Tape Test

Each substrate was placed on a hard surface and a 5 cm×5 cm piece of TesaFix tape was applied and pressed downwards until no air bubbles were visible. The arrangement was left overnight and the tape was then pulled away from the surface in about 1 second and at an angle of about 45°. Good adhesion of the hydrophilic layer was indicated by no coating being attached to the tape when it was pulled from the surface.

Assessment 3: Ink Receptivity

This was assessed by applying Rapidink to a coated surface using a damp sponge and visually assessing whether or not the surface was ink receptive.

The substrate (more particularly, the coating formulation prepared as described in Example 10, Step 3) was assessed as described above in Assessments 1 to 3. In each case, the coating was found to be scratch and peel resistant and non-ink receptive.

Other Assessments

The plate of Example 10 was found to provide good contrast between image and non-image areas (pre- and post development); to have non-image areas which were not stained by the dye in the image layer removed; to have excellent durability shown in a press test where after 500,000 impressions the plate was showing only slight wear; to show excellent ink-water balance on the press; to have excellent resistance to developer over a range of extreme conditions; to produce dots with high roundness; to be capable of high resolution; to be capable of wide exposure latitude; and to be capable of a broad dot range.

Each feature disclosed in this application may be replaced by an equivalent feature. Thus, each feature disclosed is only an example of a generic series of equivalent features.

Having described the invention, we now claim the following and their equivalents.

What is claimed is:

1. A substrate for a planographic printing member, the substrate comprising:

support; and a hydrophilic layer;

in which:

the hydrophilic layer comprises:

a particulate material; wherein the particulate material comprises a first particulate material and a second particulate material; wherein the first particulate material is alumina and the second particulate material is titanium dioxide; and the wt % ratio of titanium dioxide to alumina in the hydrophilic layer is in the range of 0.5 to 2 and a binder for the particulate material;

and the hydrophilic layer has a surface roughness of about 0.1 μm to 2 μm.

2. The substrate of claim 1 in which the surface roughness is from at least 0.2 μm to less than 1.5 μm.

3. The substrate of claim 2 in which the hydrophilic layer has a surface skewness of greater than 0.5.

4. The substrate of claim 3 in which the hydrophilic layer has a reflectance FT-IR spectrum that comprises at least one peak in one of the following ranges: 1200 to 1300 $cm^{-1}$, 1100 to 1200 $cm^{-1}$, and 900 to 1000 $cm^{-1}$.

5. The substrate of claim 4 in which the whiteness value is at least 75 and less than 100.

6. The substrate of claim 5 in which the gloss value is at least 5 and less than 20.

7. The substrate of claim 6 in which the hydrophilic layer comprises a material having Si—O bonds.

8. The substrate of claim 7 in which the support is aluminum.

9. The substrate of claim 7 in which the support is a plastic material.

10. The substrate of claim 1 in which the hydrophilic layer comprises a material having Si—O bonds.

11. The substrate of claim 10 in which the surface roughness is from at least 0.2 μm to less than 1.5 μm.

12. The substrate of claim 11 in which:

the hydrophilic layer has a surface skewness of greater than 0.5;

the hydrophilic layer has a reflectance FT-IR spectrum that comprises at least one peak in one of the following ranges: 1200 to 1300 $cm^{-1}$, 1100 to 1200 $cm^{-1}$, and 900 to 1000 $cm^{-1}$;

the whiteness value is at least 75 and less than 100; and the gloss value is at least 5 and less than 20.

13. The substrate of claim 1 in which:

the mean particle size of the first particulate material is from at least 0.1 μm to less than 200 μm;

the mean particle size of the second particulate material is from at least 0.001 μm to less than 200 μm;

the ratio of the wt % of the first particulate material to binder material is in the range of 0.5 to 2; and the ratio of the wt % of the second particulate material to binder material is in the range of 0.5 to 2.

14. The substrate of claim 13 in which the hydrophilic layer comprises a material having Si—O bonds.

15. The substrate of claim 14 in which the surface roughness is from at least 0.2 μm to less than 1.5 μm.

16. The substrate of claim 15 in which the ratio of the wt % of the first particulate material to the second particulate material as measured by energy dispersive X-ray analysis is about 1:1.

17. The substrate of claim 14 additionally comprising an image layer.

18. The substrate of claim 17 in which the image layer carries information in a stochastic form.

19. The substrate of claim 14 in which the ratio of the wt % of the first particulate material to the second particulate material is about 1:1.

20. The substrate of claim 14 in which the first particulate material and the second particulate material define a bimodal particle size distribution.

21. The substrate of claim 20 in which the particle size of the first particulate material is in the range of at least 1 μm and less than 5 μm, and the particle size of the second particulate material is at least 0.1 μm and less than 0.5 μm.

22. The substrate of claim 21 in which the support is aluminum.

23. The substrate of claim 21 in which the support is a plastic material.

24. The substrate of claim 1 in which the first particulate material and the second particulate material define a bimodal particle size distribution.

25. The substrate of claim 24 in which the support is aluminum.

26. The substrate of claim 24 in which the support is a plastic material.

27. The substrate of claim 1 wherein the hydrophilic layer comprises at least 10 wt % of the first particulate material and at least 10 wt % of the second particulate material.

28. The substrate of claim 1 wherein the titanium dioxide is coated with an inorganic coating.

29. The substrate of claim 1 wherein the titanium dioxide is anatase titanium dioxide.

30. A substrate for a planographic printing member, the substrate comprising:

a support; and a hydrophilic layer over said support: in which:

the hydrophilic layer comprises a binder material and a particulate material;

the binder material comprises at least 50% of a polymeric material that has Si—O bonds;

the binder material comprises substantially no polymeric organic material;

the particulate material comprises a first particulate material and a second particulate material;

the first particulate material is alumina particles with a mean particle size in the range of 1.0 μm to 5.0 μm; the second particulate material is titanium dioxide particles with a mean particle size in the range of 0.05 μm to 0.5 μm.

31. The substrate of claim 30 in which the titanium dioxide particles are coated with a material that is harder than the titanium dioxide particles.

32. The substrate of claim 31 in which the titanium dioxide particles are coated with a coating comprising alumina.

33. The substrate of claim 30 in which the titanium dioxide particles are selected from the group consisting of rutile titanium dioxide particles and anatase titanium dioxide particles.

34. The substrate of claim 30 in which the binder material comprises at least 10 wt % and less than 40 wt % of the hydrophilic layer and the particulate material comprises at least 20 wt % and less than 80 wt % of the hydrophilic layer.

35. The substrate of claim 30 in which the binder material comprises at least 95 wt % of the polymeric material having Si—O bonds.

36. The substrate of claim 35 in which the binder material consists essentially of the polymeric material having Si—O bonds.

37. The substrate of claim 30 in which the polymeric material comprises —Si—O—Si—O— moieties.

38. The substrate of claim 37 in which the binder material comprises substantially no polymeric organic material.

39. The substrate of claim 30 in which the titanium dioxide particles and the alumina particles together comprise at least 75 wt % of the particulate material in the hydrophilic layer.

40. The substrate of claim 30 additionally comprising an image layer over the hydrophilic layer, the image layer comprising a photosensitive material.

41. The substrate of claim 40 in which the photosensitive material is a quinone diazide material.

42. A method of preparing a printing member carrying printable information, the method comprising exposing and developing an image layer of a printing member to form the printable information, the printing member comprising:

a support;

a hydrophilic layer comprising a material having Si—O bonds; and the image layer;

in which:

the hydrophilic layer comprises a particulate material and a binder for the particulate material; and the hydrophilic layer has a surface roughness of about 0.1 μm to 2 μm;

the image layer has an exposure latitude of greater than 1.2;

the image layer is processable to a resolution of 10 μm or less; and the printable information comprises dots that have a roundness of less than 2 and has a Stouffer Clear 3 of at least 99%.

43. The method of claim 42 in which the surface roughness is from at least 0.2 μm to less than 1.5 μm.

44. The method of claim 43 in which:

the particulate material comprises a first particulate material and a second particulate material;

the mean particle size of the first particulate material is from at least 0.1 μm to less than 200 μm;

the mean particle size of the second particulate material is from at least 0.001 μm to greater 200 μm;

the ratio of the wt % of the first particulate material to binder material is in the range of 0.5 to 2;

the ratio of the wt % of the second particulate material to binder material is in the range of 0.5 to 2;

the substrate of claim 12 in which the surface roughness is from at least 0.2 μm to less than 1.5 μm;

the first particulate material is alumina and the second particulate material is titanium dioxide;

in which the ratio of titanium to aluminum in the hydrophilic layer is in the range of 0.5 to 2; and the first particulate material and the second particulate material define a bimodal particle size distribution.

45. The method of claim 44 in which the particle size of the first particulate material is in the range of at least 1 μm and less than 5 μm, and the particle size of the second particulate material is at least 0.1 μm and less than 0.5 μm.

* * * * *

UNITED STATES PATENT AND TRADEMARK OFFICE

CERTIFICATE OF CORRECTION

PATENT NO. : 6,357,351 B1
DATED : March 19, 2002
INVENTOR(S) : Bhambra et al.

It is certified that error appears in the above-identified patent and that said Letters Patent is hereby corrected as shown below:

Column 24,
Line 4, before "support" insert therefore -- a --.

Signed and Sealed this

Twentieth Day of August, 2002

*Attest:*

*Attesting Officer*

JAMES E. ROGAN
*Director of the United States Patent and Trademark Office*